United States Patent [19]

Shimojima et al.

[11] Patent Number: 4,611,765

[45] Date of Patent: Sep. 16, 1986

[54] ROLLER MILL

[75] Inventors: Katsuhiko Shimojima; Masaki Hamaguchi, both of Kobe; Hiroshi Obana, Narashino; Takemi Aizawa, Funabashi; Hiroyuki Ninomiya, Tokyo, all of Japan

[73] Assignees: Onoda Cement Co., Ltd., Onoda; Kabushiki Kaisha Kobe Seikosho, Kobe, both of Japan

[21] Appl. No.: 709,030

[22] PCT Filed: Jun. 28, 1984

[86] PCT No.: PCT/JP84/00334

§ 371 Date: Feb. 28, 1985

§ 102(e) Date: Feb. 28, 1985

[87] PCT Pub. No.: WO85/00302

PCT Pub. Date: Jan. 31, 1985

[30] Foreign Application Priority Data

| | | | |
|---|---|---|---|
| Jun. 30, 1983 | [JP] | Japan | 58-120844 |
| Jun. 30, 1983 | [JP] | Japan | 58-120845 |
| Oct. 13, 1983 | [JP] | Japan | 58-193003 |

[51] Int. Cl.[4] ..... B02C 15/00

[52] U.S. Cl. ..... 241/121; 241/293

[58] Field of Search ..... 241/293, 294, 117–122

[56] References Cited

U.S. PATENT DOCUMENTS

| | | | |
|---|---|---|---|
| 332,488 | 12/1885 | Carhart | 241/293 X |
| 896,954 | 8/1908 | Thomson | 241/117 X |
| 2,689,689 | 9/1954 | Engler | 241/121 |
| 4,067,503 | 1/1978 | Broman | 241/117 X |

FOREIGN PATENT DOCUMENTS

| | | | |
|---|---|---|---|
| 531817 | 1/1922 | France | 241/117 |

*Primary Examiner*—Mark Rosenbaum

*Attorney, Agent, or Firm*—Oblon, Fisher, Spivak, McClelland & Maier

[57] ABSTRACT

A roller mill in which raw material fed between the upper surface of a pulverizing table and a pulverizing roller is pulverized by compression therebetween, wherein at least one annular recess coaxial with a roller shaft being formed on the pulverizing roller, thereby attaining reduction of self-excited vibrations of the roller mill and improvement of the pulverization efficiency. Further, in order to enhance these effects, the depth of the recess is set larger than the average grain size of the raw material. Moreover, the gap between the pulverizing table and the pulverizing roller has a wedge-like sectional shape which becomes narrower toward the outside of the pulverizing table, whereby the raw material which has been pulverized by compression between the table and the roller is prevented from escaping in the axial direction of the roller shaft, thereby attaining reduction of the self-excited vibration and improvement of the pulverization efficiency.

6 Claims, 36 Drawing Figures

FIG. 9 (A-1)
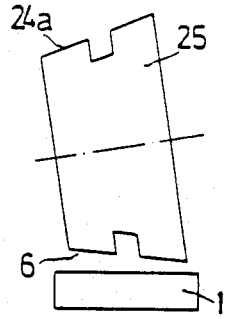
FIG. 9 (A-2)
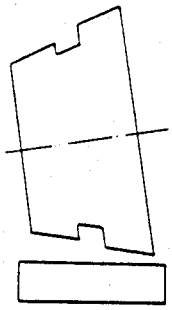
FIG. 9 (A-3)
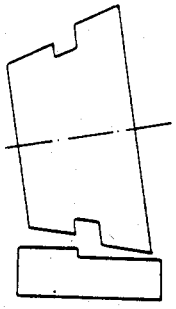
FIG. 9 (A-4)
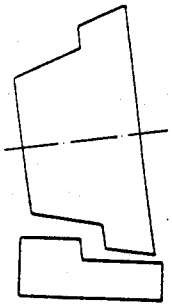
FIG. 9 (B-1)
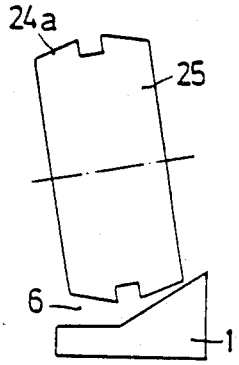
FIG. 9 (B-2)
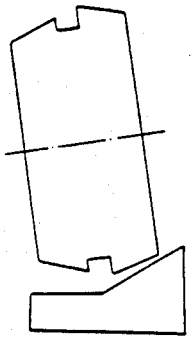
FIG. 9 (B-3)
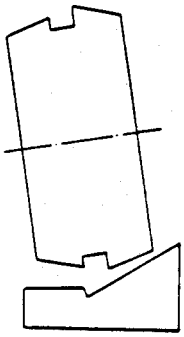
FIG. 9 (B-4)
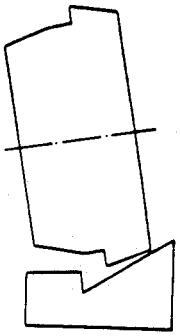
FIG. 9 (C-1)
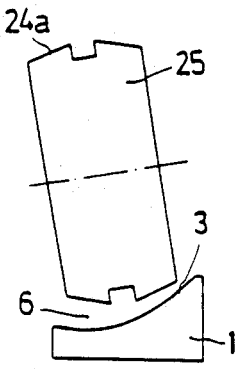
FIG. 9 (C-2)
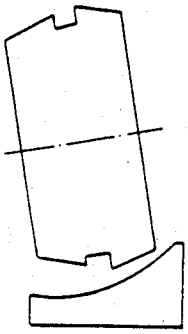
FIG. 9 (C-3)
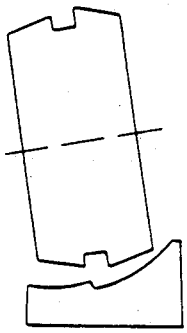
FIG. 9 (C-4)
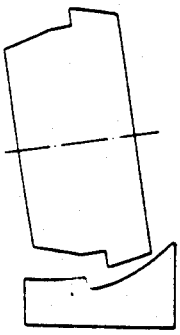

ROLLER MILL

TECHNICAL FIELD

The present invention relates to an improvement of a roller mill in which raw material fed onto a pulverizing table rotating in a substantially horizontal plane around a vertical shaft is pulverized by compression between the pulverizing table and rotatable pulverizing rollers which are pressed toward the upper surface of the pulverizing table. More particularly, it is concerned with a roller mill which aims at reduction of vibration and improvement of pulverization efficiency.

BACKGROUND ART

Tube mill such as ball mill having a high pulverizing capability has heretofore been used for the pulverization of solid materials of a high hardness such as cement clinker and blast furnace slag. But, such tube mill is less efficient and increases the running cost and is therefore very uneconomical.

Under the circumstances, various studies have been made from the desire that the above roller mill which is relatively satisfactory in point of efficiency be utilized for the pulverization of cement clinker and blast furnace slag.

However in the case of roller mill, unlike tube mill, the pulverization of raw material is performed not by collision between pulverizing medium such as balls and raw material and by grinding, but raw material stuck between a pulverizing table and pulverizing rollers both supported by a machine frame is to be pulverized by virtue of the gripping force of both table and rollers. Consequently, vibrations of the pulverizing rollers, etc. are in many cases transferred to the machine frame, thereby creating extremely large vibrations as compared with the use of tube mill. For this reason, there are many who hesitate to use roller mill for the pulverization of very hard solid materials such as cement clinker and blast furnace slag.

Roller mill is generally considered superior in pulverization efficiency to tube mill, but the efficiency of roller mill presently available is not always satisfactory and it is considered that there is a considerable room for improvement.

Vibrations in such roller mill, above all, those induced by the vibration or pulverizing rollers, are broadly classified into (1) those attributable to the hardness of raw material or changes thereof and (2) so-called self-excited vibrations caused by slipping of raw material. The present invention aims at reducing the latter or self-excited vibration and improving pulverization efficiency. The cause of such self-excited vibration will be explained below with reference to FIGS. 1 to 5.

FIG. 1 is a sectional side view showing an example of structure of a conventional general roller mill, in which the reference numeral 1 denotes a pulverizing table which is positively rotated in a horizontal plane about a vertical axis 2 by means of a drive source such as a motor (not shown).

In the upper surface of the pulverizing table 1 is formed an annular groove 3 around the vertical shaft 2. As shown in the figure, the annular groove 3 has an arcuate section which is depressed downward.

Mounted above the pulverizing table 1 are a set of pulverizing rollers 5*a* and 5*b* whose outer periphreal surfaces 4 are opposed to and urged toward the annular groove 3 through a gap 6.

More specifically, the pulverizing rollers 5*a* and 5*b* are rotatably supported by roller shafts 9*a* and 9*b* which are inserted into a pulverizing chamber 8 through a casing 7. The roller shafts 9*a* and 9*b* are fixed to frames 11*a* and 11*b* which are swingably on horizontal shafts 10*a* and 10*b* in a vertical plane, the shafts 10*a* and 10*b* being provided outside the body casing 7. A bolt 13*a* (only one being shown) is threadedly secured to an arm 12*a* (only one being shown), and the head of the bolt 13*a* (13*b* ) is adapted to abut the frame 11*a* (11*b*), thereby setting the minimum limit of the width of the gap 6 between the pulverizing rollers 5*a*, 5*b* and the annular groove 3.

The fore end portions of the above set of frames 11*a* and 11*b* are connected so that they can be pulled by a tension device 14 and rods 15*a* and 15*b*. Consequently, the top portion sides of the frames 11*a* and 11*b* undergo pivotal urging forces in directions approaching each other as indicated with arrows A, whereby the pulverizing rollers 5*a* and 5*b* are urged toward the annular groove 3. In this case, the pivotal motion of the frames 11*a* and 11*b* in the direction of arrow A is restricted by the bolts 13*a* and a similar bolt (not shown) as mentioned above, and after the minimum limit width of the gap 6 is set.

Therefore, the raw material fed to the central part of the upper surface of the pulverizing table 1 is moved in the outer peripheral direction, that is, into the annular groove 3, by the truncated cone-like upper surface shape formed at the central part of the pulverizing table 1 and the centrifugal force created by the rotation of the pulverizing table 1, and is stuck into the gap 6 between the pulverizing rollers 5*a*, 5*b* and the pulverizing table 1 and thereby pulverized under pressure.

But, in the event the thickness of the raw material layer stuck below one pulverizing roller, e.g. 5*a*, is too large, the pulverizing roller 5*a* pivots in an upwardly escaping direction against the pivotal urging force of the tension device 14, and its pivoting force is transmitted through the tension device 14 and rod 15*b* to the frame 11*b* to which is attached the opposite-side pulverizing roller 5*b*, so that the urging force of the pulverizing roller 5*b* toward the annular groove 3 is enhanced. Thus, the urging forces of the pulverizing rollers 5*a* and 5*b* are automatically adjusted according to changes in layer thickness of raw material.

In this way, the raw material which has been pulverized by the rollrs 5*a* and 5*b* moves to the outer peripheral side of the pulverizing table 1 by virtue of the centrifugal force of the pulverizing table 1, and is blown up by an upwardly air current introduced from an upward nozzle 16 which surrounds the outer periphery of the pulverizing table 1. Then, separation by particle size is performed by means of a separator (now shown) disposed at an upper part of the pulverizing chamber 8, and only fine particles not larger than a predetermined particle size are taken out of the pulverizing chamber 8, while coarse particles larger than the predetermined particle size are returned to the upper surface of the pulverizing table 1 and again subjected to pulverization treatment.

As shown in FIG. 2, in the conventional roller mill, between a radius of curvature, r, of the outer peripheral surface 4 of the pulverizing roller 5*a* (5*b*) when cut by a plane including the roller shaft 9*a* or 9*b* and a radius of curvature, R, of the annular groove 3 when cut by a plane including the roller shaft 9a or 9b, there exists the relationship of $R>r$.

In the example shown in FIG. 2(*a*), $R=R_1$, $r=r_1$, $R_1=r_1+d_1$, $d_1=d_0$, and thus the thickness, d, in the roller radial direction of the gap 6 between both curved surfaces is constant ($d_1=d_0$). In the example shown in (b) of the same figure, $R=R_1$, $r=r_2$, $R_1>r_2+d_2$, $d_2>d_0$, and the thickness, d, of the gap 6 between both curved surfaces is set so that the thickness, $d_2$, of the front or rear end side is always larger than the thickness, $d_0$, of the central part.

In the case of roller mill, moreover, as shown in FIG. 3 which is a front view of the pulverizing roller 5, the pulverization of raw material is performed not at a point 16 just under the roller at which the compression is maximum, but at a point 17 (located behind by distance from the roller center) located this side (right-hand side in the figure) when viewed in the advancing direction (arrow) of the pulverizing table 1. Further, as shown in FIG. 4 which is a plan view of the pulverizing roller 5, the peripheral speed $F_4$ in the rotating direction of the outer periphery of the roller 5 shifts by an angle of $\alpha$ relative to a peripheral speed $F_3$ in the rotating (tangential) direction of the pulverizing table 1 at the sticking point 17, and in accordance with this shift angle a shearing force in the direction of $F_5$ acts on the raw material located just under the sticking point 17. Flow of the raw material powder is induced also by this shearing force $F_5$, which is presumed to enhance the self-excited vibration.

Further, comparison between the peripheral speed of the outer peripheral surface 4 of the pulverizing roller 5 in the vicinity of the sticking point 7 and that of the annular groove 3 of the pulverizing table 1 can be diagrammatically shown as in FIG. 5. More specifically, the peripheral speed on the side of the annular groove 3 is proportional to the radius from the rotational center 0 of the pulverizing table 1. For example, when the outer peripheral surface 4 of the pulverizing roller 5 is viewed in the width direction, if the peripheral speed at point 17*a* relatively close to the center 0 is Va and that at point 17*b* relatively far from the center 0 is Vb, there exists the relation of $Vb>Va$, and since the peripheral speed Vo of the peripheral surface 4 of the pulverizing roller 5 is a mean value of Va and Vb, there exists the relation of $Vb>Vo>Va$.

Between the outer peripheral surface 4 of the pulverizing roller 5 and the annular groove 3 there occurs a slip which is caused by the above difference in peripheral speed, and a shearing force induced by this slip creates flow of the raw material powder in the gap 6, which is cause of occurrence of the foregoing self-excited vibration.

Thus, the self-excited vibration of the pulverizing roller 5 is caused by the flow of the raw material powder in the direction of the roller shaft 9 in the gap 6. In this connection, in the conventional roller mill, as shown in FIGS. 1 and 2, the thickness of the gap 6 is either constant when viewed in the direction of the roller shaft 9 [FIG. 2(*a*)] or is larger at the front or rear end portion than at the central portion [FIG. 2(*b*)]. In any event anyhow, the gap 6 is in a forwardly or rearwardly opened state, not assuming a shape capable of preventing the flow of raw material formed in the gap 6, and thus the structure permits easy occurrence of self-excited vibrations.

Further, the pulverization in the roller mill is effected by both compressive and shearing forces. If the respective force regions are called adhesion region (compression region) A and slip region (shear region) B, as shown in FIG. 6, the raw material which has been coarsely pulverized in the adhesion region is finely pulverized in the slip region. At this time, is a force is applied to a powder layer C by the roller, it is very likely with a roller shape as in FIG. 2(*a*) that the powder layer C will flow out to the right and left sides of the roller. Moreover, the larger the width or diameter of the roller, the larger the slip region B, and in this case the shearing force is enhanced, so that the efflux probability of paticles becomes larger. Both these influences combine to cause the powder efflux phenomenon. In short, the large area of the slip region B is the main cause and this combines with the defective roller shape to create said phenomenon.

DISCLOSURE OF THE INVENTION

In view of the above-mentioned points, the present invention aims at reducing the self-excited vibration and improving the pulverization efficiency by preventing the flow of raw material in the roller shaft direction in the gap between the pulverizing rollers and the annular groove formed in the pulverizing table. The gist of the present invention resides in a roller mill for pulverizing raw material fed onto a pulverizing table by virtue of compression between the pulverizing table and pulverizing rollers rotatably supported by roller shafts and pressed toward the upper surface of the pulverizing table, in which the outer peripheral surface of each said pulverizing roller is formed with at least one annular pulverizing groove coaxial with the roller shaft which support the pulverizing roller.

BRIEF DESCRIPTION OF THE DRAWINGS

Various other objects, features and attendant advantages of the present invention will be more fully appreciated as the same becomes better understood from the following detailed description when considered in connection with the accompanying drawings in which like reference characters designate like or corresponding parts throughout the several views and wherein:

FIGS. 9(A-1)-(C-4), 12(1)-(4), 13(1)-(4) and 14(1)-(4) are schematic explanatory views in which the relation between the pulverizing roller and the pulverizing table is shown in terms of other embodiments.

BEST MODE FOR CARRYING OUT THE INVENTION

Embodiments of the present invention will be described below with reference to the accompanying drawings of FIG. 7 et seq. to further illustrate the invention.

Figure 7:
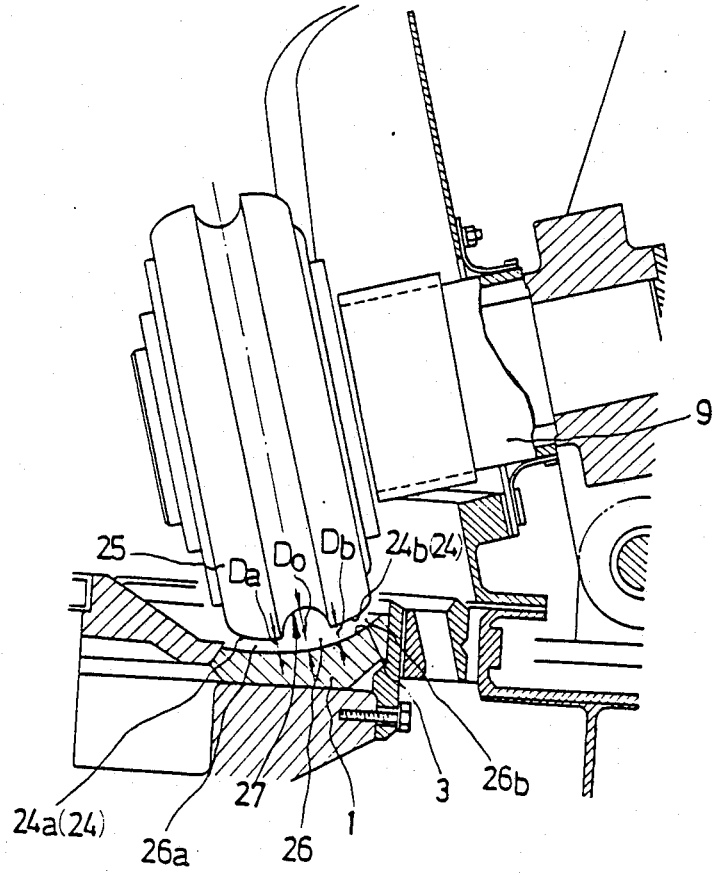
FIG. 7 is a sectional side view showing a relation between a pulverizing roller and pulverizing table in a roller mill according to an embodiment of the present invention.

First, FIG. 7 is a sectional side view of a pulverizing roller and a pulverizing table in a roller mill according to an embodiment of the present invention.

In FIG. 7, a pulverizing roller 25 is pressed toward an annular groove 3 formed in the upper surface of a pulverizing table 1, and an outer peripheral surface 24 of the pulverizing roller 25 is formed with an annular recess 27 coaxial with a roller shaft 9 in the central portion when viewed in the roller shaft direction, and thus the pulverizing roller 25 itself has a shape constricted by the recess 27. Although the number of such recesses is not limited in the present invention, FIG. 7 shows only one recess formed centrally in the width direction of the pulverizing roller 25.

Although the illustrated sectional shape of the recess 27 is generally semi-circular, it may be replaced by any other desired shape, for example, a square, trapezoid or triangular shape. The central portion of the pulverizing roller 25 with recess 27 formed therein does not contribute to pulverization at all, and if it is too shallow, the roller life will be shortened by wear, so its depth should be determined in consideration of this point.

In this embodiment, the central groove of the pulverizing roller 25 contributes to the reduction of the slip area and the shearing force induced by the pressing force and the table rotation is thereby decreased. As a result, there will not occur a self-excited vibration even when the roller shape involves the foregoing defect. That is, the area of the pulverizing portion of the pulverizing roller 25 can be adjusted by changing the design of the recessed portion, and since it is possible to catch and pulverize raw material powder in an ideal fashion, the pressing force can be exerted effectively on the powder layer. Consequently, not only the self-excited vibration caused by collapse of the powder layer is prevented, but also the effect of enhancing the pulverization efficiency can be attained.

Since the conventional roller mill is of a structure which permits an efflux (escape) of raw material from the gap 6 between th pulverizing roller 25 and the pulverizing table 1, the raw material escapes before the pressing force $F_1$ of the pulverizing roller 25 effectively acts on the raw material powder, that is, the compressive pulverization is not performed to a satisfactory extent, and this is a cause of lowering the pulverization efficiency of the roller mill. This problem may be solved by forming the gap between the outer peripheral surface of the pulverizing roller and the upper surface of the pulverizing table into the shape of a wedge in section which gradually decreases in sectional area toward the outside of the pulverizing table. Actually, as a result of adoption of such a construction it was found that the raw material which had been pulverized under pressure between the pulverizing roller and the pulverizing table was prevented from escaping (flowing) in the radial direction of the pulverizing table and that the pulverizing efficiency was improved.

The above wedge shape is given by forming on the outer peripheral surface of the pulverizing roller a tapered surface which gradually decreases in sectional area toward the fore end of the roller shaft. Thus, the gap between the outer peripheral surface of the pulverizing roller and the annular groove of the pulverizing table is made narrower in a wedge form toward the outside when viewed in the radial direction of the pulverizing table, whereby the outward flow of raw material is restricted.

Figure 8:
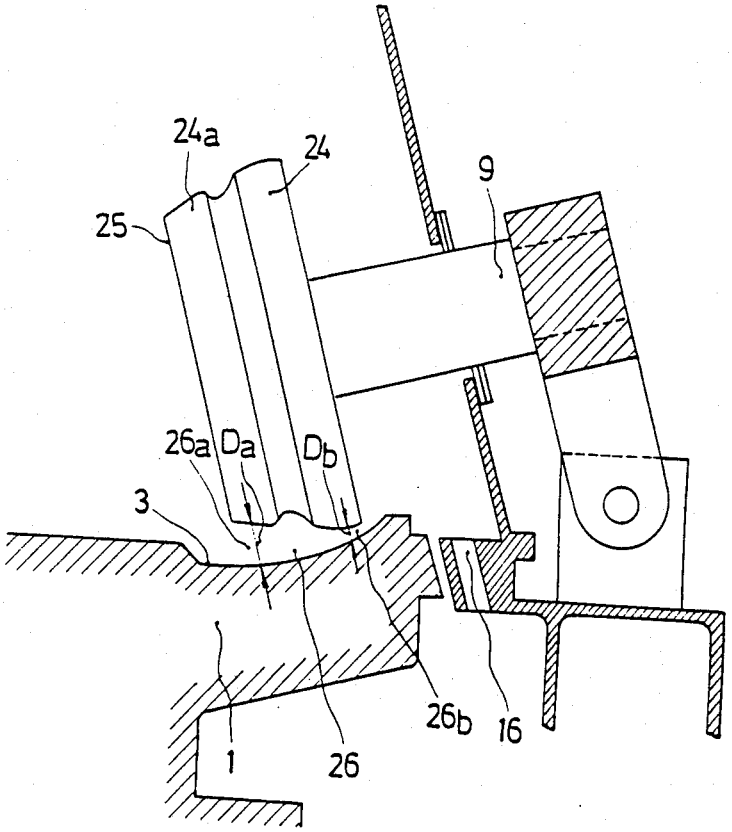
FIGS. 8, 10 and 11 are schematic sectional side views showing relations between the pulverizing roller and the pulverizing table.

The construction as well as the function and effect of the wedge form will be described below in more detail with reference to FIGS. 8 and 9. Reference is made first to FIG. 8, which is a schematic sectional side view of a roller mill according to an embodiment of the present invention.

On the fore end portion of the outer peripheral surface 24 of the pulverizing roller 24 is formed a tapered surface **24*a* such that the sectional area when cut by a plane perpendicular to the roller shaft 9 decreases gradually toward the fore end of the roller shaft 9. Between the tapered surface 24*a* and the annular groove 3 is formed a gap 26 which is so shaped as to become narrow toward the outside when viewed in the radial direction of the pulverizing table 1. Therefore, the thickness Db of an outlet portion 26*b* of the gap 26 is smaller than the thickness Da of its inlet portion 26*a***.

Using the pulverizing roller of the above, pulverization is performed in the following manner.

Raw material fed to the central part of the pulverizing table 1 moves in the radial direction of the table 1 by virtue of a centrifugal force induced by the rotation of the same table as previously noted, and flows into the annular groove 3. Then, it is stuck into the gap 26 between the table and the pulverizing roller 25 which is pressed onto the annular groove 3.

On the other hand, the gap 26 between the annular groove 3 of an arcuate section and the tapered surface **24*a* of the pulverizing roller 25 is formed in the shape of a wedge whose sectional area decreases toward the outside as previously described. Consequently, the raw material which tries to flow outward causes clogging at the outlet portion 26*b*, that is, the outward flow of raw material is suppressed. Therefore, only the raw material that has fully been pulverized by the compression at the outlet portion 26*b* which substantially contributes to the pulverizing action as previously noted passed through the said outlet portion and is discharged to the outer peripheral portion of the pulverizing table 1. After all, the thickness of the gap 26**, namely, the thickness of the powder layer, is kept stable to thereby diminish self-excited vibrations.

Further, since the outward flow of raw material is suppressed as mentioned above, there no longer exists the inconvenience that unpulverized raw material flows outwardly of the pulverizing table 1. Only the raw material that has fully been pulverized flows out toward the nozzle 16 and so the pulverization efficiency is remarkably improved.

The above effect of improvement of the pulverization efficiency is attained by the wedge form of the gap 6 between the pulverizing roller 25 and the pulverizing table 1 of wedge form is narrower toward the outside of the table 1. Therefore, as embodiments for providing wedge forms, those based on relative relations between the outer peripheral shape of the pulverizing roller 25 and that of the pulverizing table 1, as schematically shown in terms of various patterns in FIG. 9, are all included in the technical scope of the present invention. For example, in each of four A-series embodiments in FIG. 9, the entire section parallel to the axis of the pulverizing roller 25 is formed in a trapezoidal shape to thereby form a wedge-like gap 6 between the roller and the pulverizing table 1. In the B- and C-series embodiments in FIG. 9, the pulverizing table 1 increases in height gradually toward its outer peripheral side (right-hand side in the figure) to thereby form a wedge-like gap 6 between the table and the pulverizing roller 25. In each of B-series pulverizing tables 1, the outer peripheral side is formed higher by combination of straight lines, while in each of C-series pulverizing tables 1, the outer peripheral side is formed higher by a concave curved surface. Further, throughout the whole series of FIG. 9(A-1)-(C-4), the fore end-side outer peripheral surface 24*a* of the pulverizing roller 25 is made successively lower from suffix No. 1 to No. 4 (provided there is no substantial difference between suffix Nos. 2 and 3). Particularly, in suffix No. 4, the annular groove 3 is flush with the roller bottom. Such a structure is also included in the technical scope of the present invention because the foregoing self-excited vibration preventing effect can be attained by the annular groove 3. In the embodiments of suffix Nos. 3 and 4 of A, B and C series, the surface of the pulverizing table 1 is formed with a stepped portion, and even such a structure permits improvement of the pulverizing effect as long as the gap 6 is in the form of a wedge.

Thus, in the embodiments of FIGS. 8 and 9, all the pulverizing rollers 25 are linearly tapered at the respective outer peripheral surfaces, thereby attaining the wedge form of the gap 6. Now, embodiments for forming a wedge-like gap by other means will be described below with reference to FIG. 10 et seq.

Figure 1:
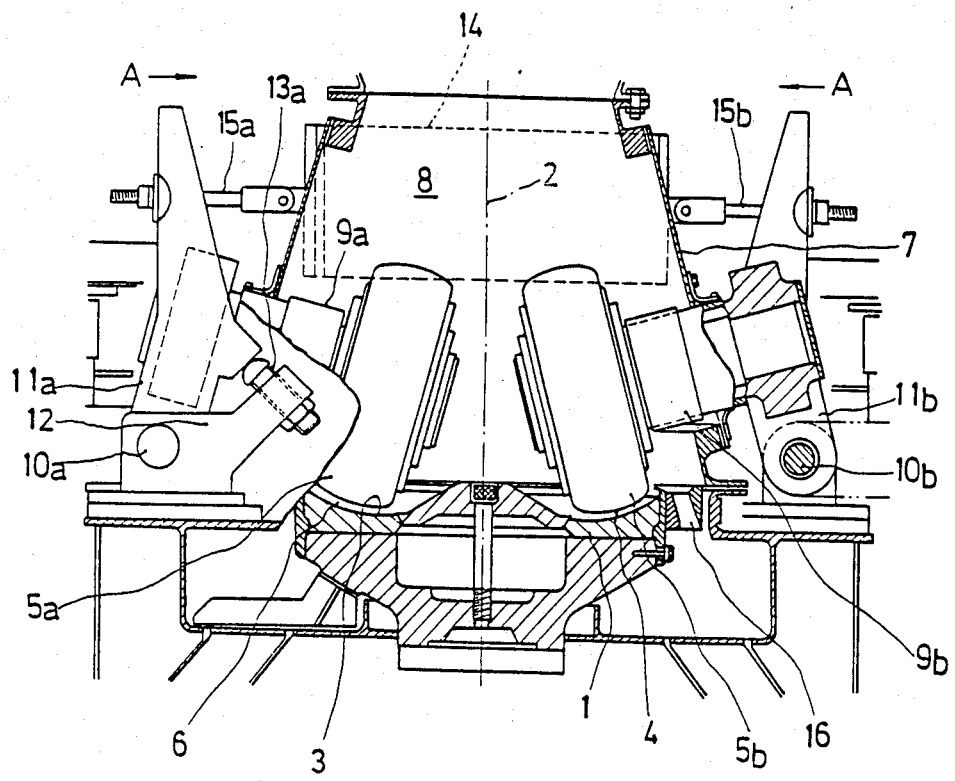
Fig. 1 PRIOR ART
FIG. 1 is a sectional side view showing an example of a conventional roller mill.
Figure 2:
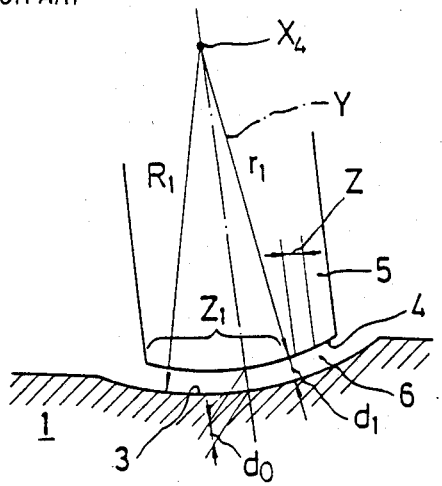
FIG. 2 (a) PRIOR ART
FIGS. 2(*a*) and 2(*b*) are each a sectional side view showing a configuration relation between a pulverizing roller and a pulverizing table in the roller mill.
Figure 2:
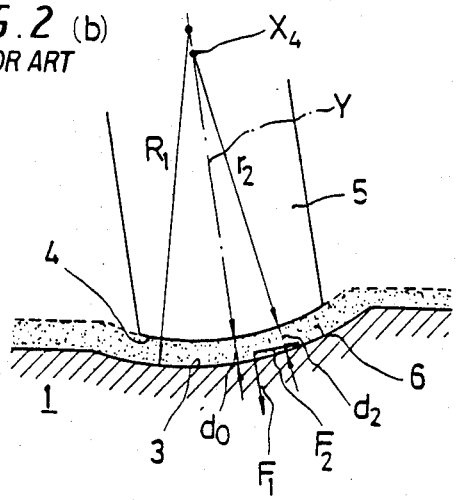
FIG. 2 (b) PRIOR ART
Figure 3:
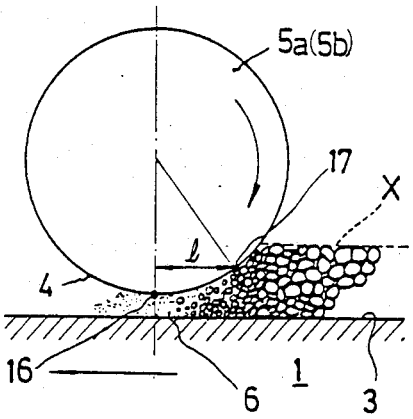
Fig 3 PRIOR ART
FIG. 3 is a front view of the pulverizing roller for explaining a pulverizing condition.
Figure 4:
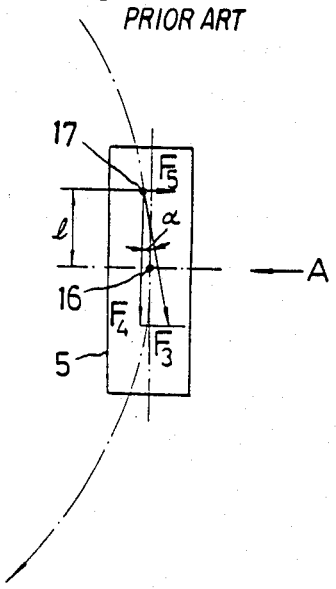
Fig 4 PRIOR ART
FIGS. 4 and 5 are plan views of the pulverizing roller.
Figure 5:
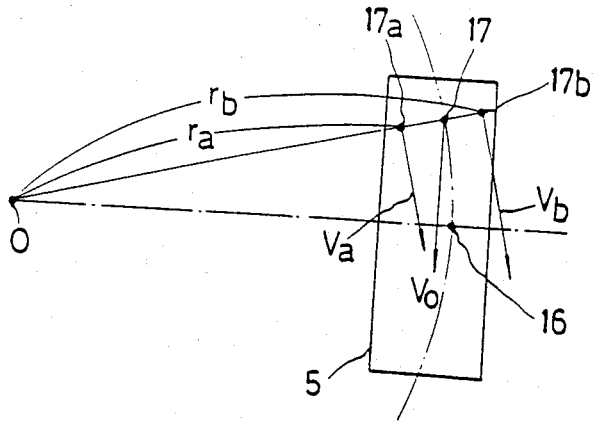
Figure 6:
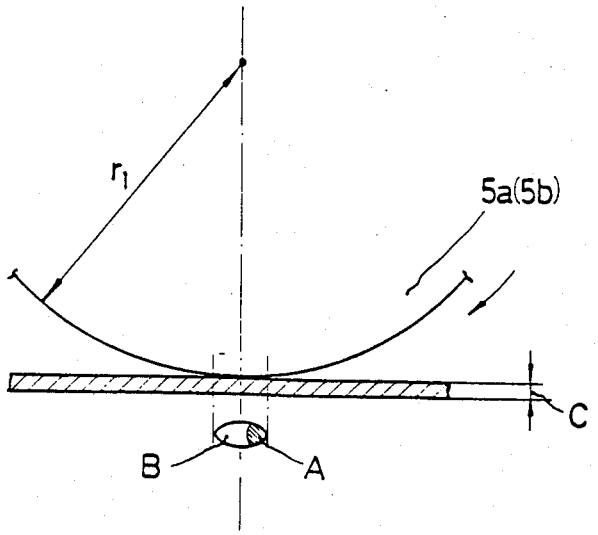
FIG. 6 is a schematic explanatory view showing a pulverising portion.
Figure 10:
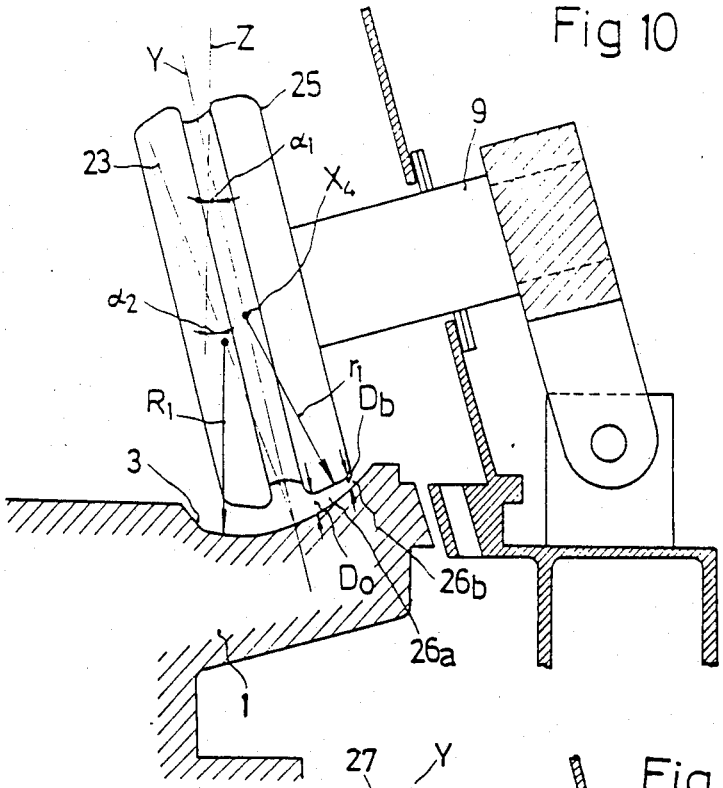

FIG. 10 is a schematic sectional side view of a pulverizing roller and a pulverizing table in a roller mill according to an embodiment of the present invention. Here also constructional elements common to FIGS. 1 and 2 will be indicated by the same reference numerals.

In FIG. 10, a sectional center line Y of a pulverizing roller 25 and a sectional center line 23 of an annular groove 3 formed in a pulverizing table 1 are not coincident with each other (both center lines are coincident in the conventional roller mill), and if the angles of both center lines relative to a perpendicular line Z are $\alpha_1$ and $\alpha_2$ respectively, the mounting position of a roller shaft 9 is determined so that $\alpha_2$ is larger than $\alpha_1$. To this end, the section of a gap 26 for compressing raw material between an outer peripheral surface 24 of the pulverizing roller 25 and the annular groove 3, cut by a vertical plane including the roller shaft, is in the form of a wedge which decreases in area toward the outside in the radial direction of the pulverizing table 1 as shown in the figure, and the thickness Db of an outlet 26*b* is smaller than the thickness Do of an intermediate portion 26*a* of the gap 26.

More specifically, in this embodiment a central point $X_4$ of the radius of curvature of the outer peripheral surface 24 which passes the sectional central line Y of the pulverizing roller 25 is made eccentric radially outwards of the pulverizing table 1 relative to the sectional center line 23 of the annular groove 3, and the angles $\alpha_1$ and $\alpha_2$ of both center lines relative to the vertical line are set so as to be $\alpha_2 > \alpha_1$ as mentioned above, thereby giving the wedge shape of the gap 26.

Figure 11:
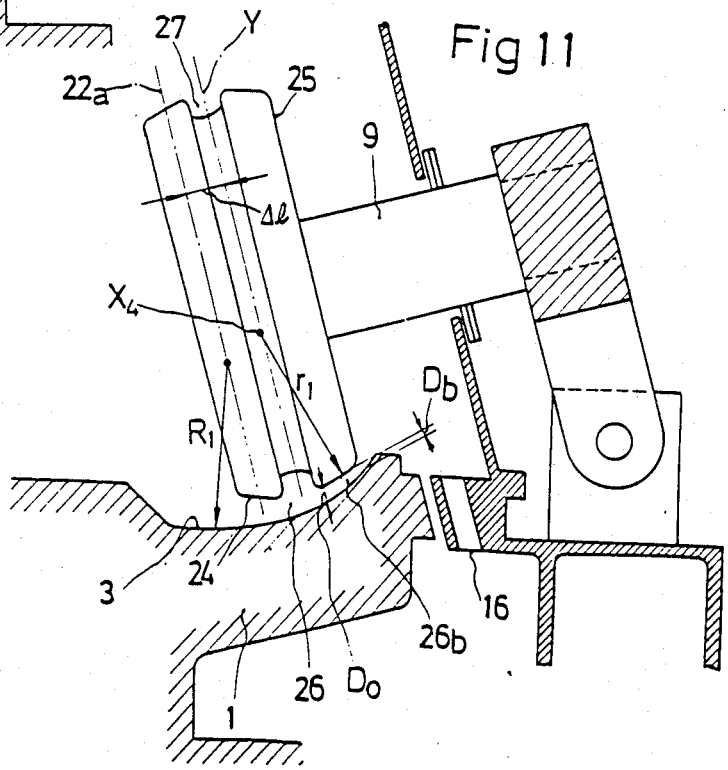

Even if $\alpha_1 = \alpha_2$ and as shown in FIG. 11 the sectional central line Y in the width direction of the pulverizing roller 25 is shifted outward relative to a sectional center line 22*a* of the annular groove 3 and in this state the pulverizing roller 25 is supported rotatably and the central point $X_4$ of the radius of curvature of the outer peripheral surface 24 of the pulverizing roller 25 is disposed outside (viewed in the radial direction of the pulverizing table 1 relative to the sectional center line 22*a* of the annular groove 3, it is possible to form a similar wedge shape.

Figure 12:
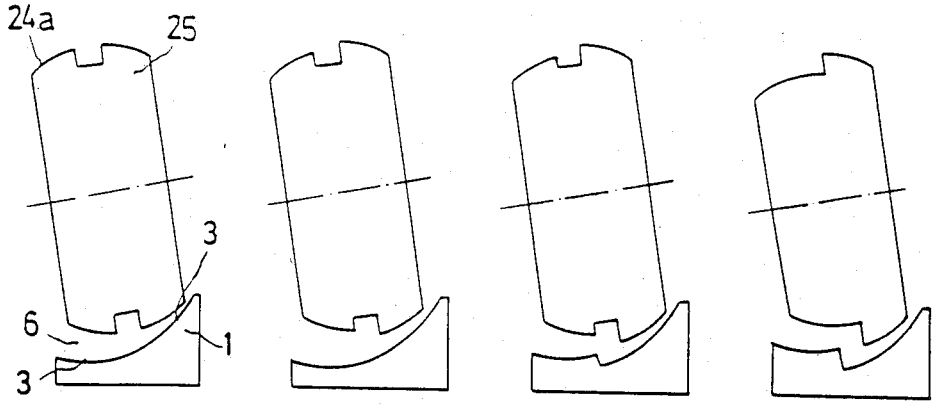

FIGS. 12(1) to 12(4) show modifications corresponding to suffix Nos. 1 to 4 in FIG. 9. Since these modifications are based on the embodiment of FIG. 10, the outer peripheral surface of each pulverizing roller 25 is spherical, and as to pulverizing tables 1, those shown as C series in FIG. 9 are used.

Figure 13:
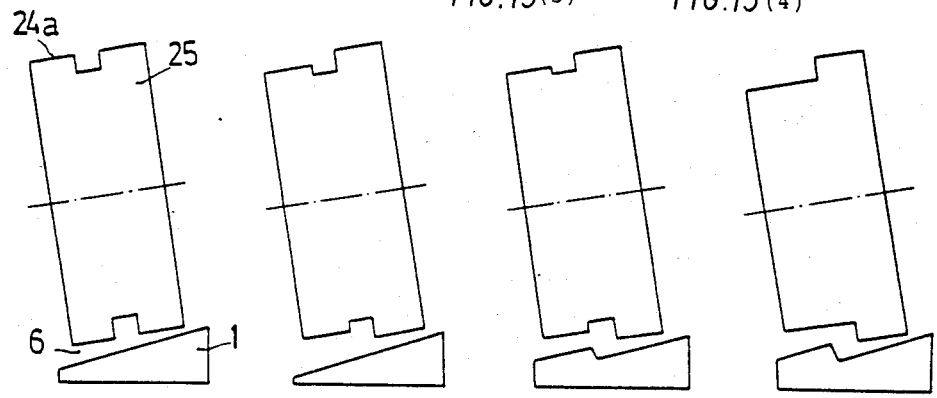
Figure 14:
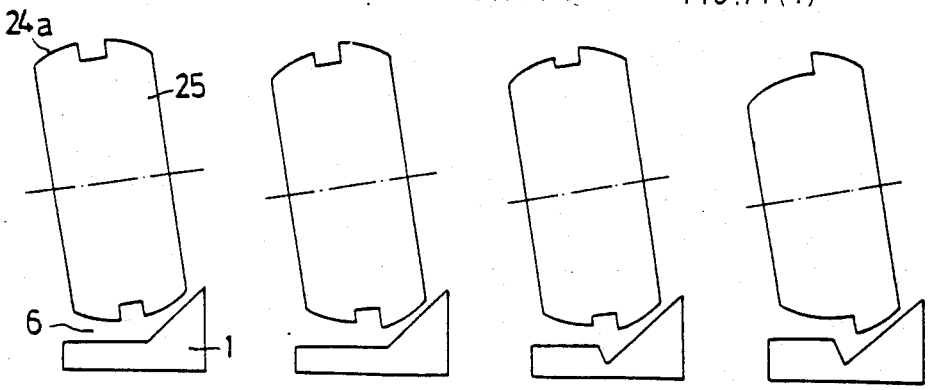

As another method for forming the gap 6 in the shape of a wedge between the outer peripheral surface of the pulverizing roller 25 and the upper surface of the pulverizing table 1, reference is here made to FIGS. 13(1) to 13(4), in which the outer peripheral surface of the pulverizing roller 25 and the upper surface of the pulverizing table 1 are both made flat and the latter is inclined relative to the former. As shown in FIGS. 14(1) to 14(4), the pulverizing rollers 25 shown in FIG. 12 may be combined with the B-series pulverizing tables 1 shown in FIG. 9, and also in this case there can be formed a wedge-like gap.

By the above construction, the raw material pulverized under pressure between the pulverizing roller and the annular groove of the pulverizing table is prevented from escaping (flowing) in the axial direction of the roller shaft, whereby not only the vibration of the pulverizing roller is suppressed but also the pulverization efficiency is improved. An example of this effect will be explained below with reference to FIG. 15.

Figure 15:
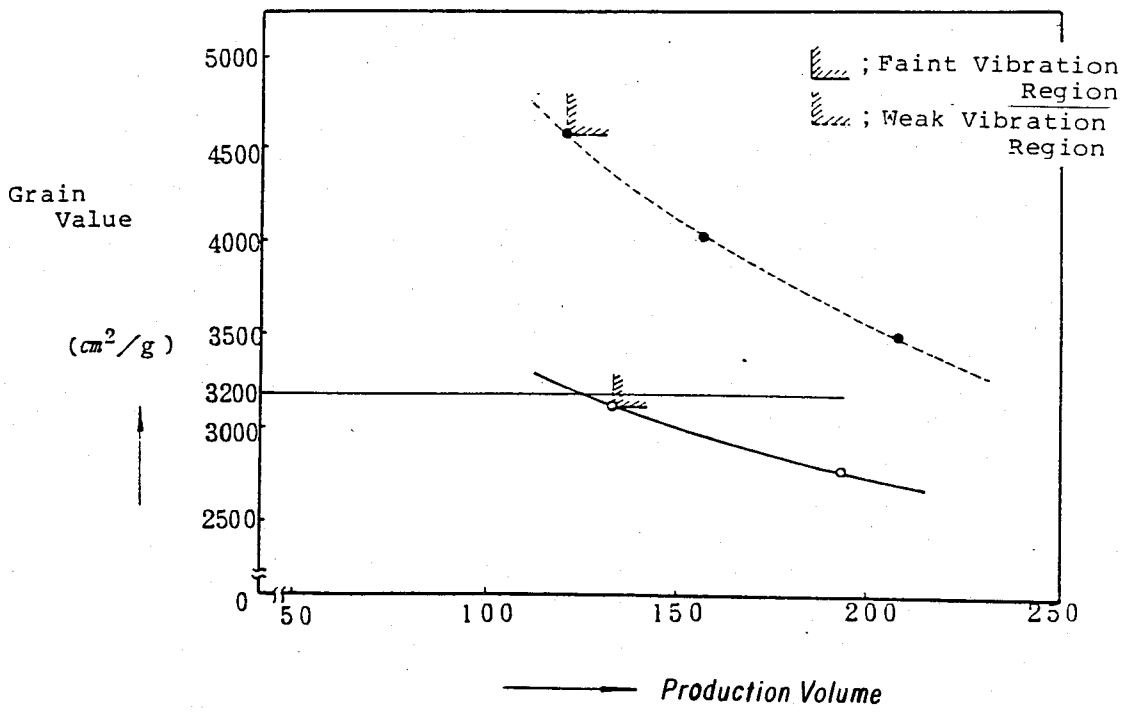
FIG. 15 is an experimentally determined graph of the relation between production volume and grain value.

FIG. 15 shows results obtained experimentally on the relation between the production volume and gran value (representing particle size in $cm^2/g$) using a conventional roller mill (while circles indicate experimental values) and the roller mill of the present invention (indicated by black circles) having a recessed portion formed in each pulverizing roller and a wedge-shaped gap formed between the outer peripheral surface of the pulverizing roller and the upper surface of a pulverizing table. As is apparent from this figure, in the case where the same amount of raw material is fed per unit hour, the present invention can afford product of much finer particles and thus is is seen that the pulverization efficiency of the roller mill of the present invention is remarkably improved.

In the graph of FIG. 15, the "faint vibration region" indicates a region in which there occurs slight vibrations not obstructing operation at all, and the "weak vibration region" indicates a region in which a larger vibration would obstruct a long-term operation and in which there occur vibrations larger than those occurring in the faint vibration region. The difference between the present invention and the conventional roller mill is thus clearly understandable.

INDUSTRIAL APPLICABILITY

In the present invention, as set forth hereinabove, in a roller mill in which raw material fed onto a pulverizing table is pulverized under pressure between the pulverizing table and pulverizing rollers which are rotatably supported by roller shafts and which are pressed toward the upper surface of the pulverizing table, at least one annular recess coaxial with the pulverizing roller supporting roller shaft is formed in the outer peripheral surface of each of the pulverizing rollers, whereby the raw material which has been pulverized under pressure between the pulverizing rollers and the annular groove of the pulverizing table is prevented from escaping (flowing) in the axial directions of the roller shafts and thereby not only the vibration of the pulverizing rollers is suppressed but also the pulverization efficiency is improved.

What is claimed is:

1. A roller mill, comprising:

a pulverizing table;

a roller shaft located in proximity to said table and having an end portion located above said table;

at least one pulverizing roller supported rotatably at said end portion of said roller shaft; and means for pressing said pulverizing roller toward an upper surface of said pulverizing table, wherein raw material fed to said pulverizing table is pulverized by compression between said pulverizing table and said at least one pulverizing roller and wherein an outer peripheral surface of said at least one pulverizing roller is formed with at least one annular recess coaxial with said roller shaft and spaced from said upper surface of said pulverizing table wherein said outer peripheral surface of said at least one pulverizing roller and an upper surface of said pulverizing table form a gap having a wedge-like sectional shape which gradually decreases in sectional area toward an outside portion of the pulverizing table and form an outlet gap at a point of minimum sectional area.

2. A roller mill according to claim 1, wherein said annular recess is formed in a central part of an outer peripheral surface of each of said at least one pulverizing roller.

3. A roller mill according to claim 1, wherein said annular recess formed in said outer peripheral surface of said at least one pulverizing roller has a depth larger than an average grain size of the raw material which has been coarsely pulverized by said pulverizing table and said at least one pulverizing roller.

4. A roller mill according to claim 1, wherein both said outer peripheral surface of the roller and said upper surface of the pulverizing table are flat, and said upper surface of the pulverizing table is inclined relative to said outer peripheral surface of the pulverizing roller, thereby forming said wedge-like gap between said outer peripheral surface of said at least one pulverizing roller and said upper surface of said pulverizing table.

5. A roller mill according to claim 1, wherein the outer peripheral surface of said at least one pulverizing roller further comprises a tapered surface which gradually decreases in sectional area toward a fore end of said pulverizing roller shaft, thereby forming said wedge-like gap between the outer peripheral surface of said at least one pulverizing roller and said upper surface of the pulverizing table.

6. A roller mill according to claim 1, wherein said upper surface of said pulverizing table is formed with a downwardly recessed annular groove of an arcuate section, and a central point of a radius of curvature of said outer peripheral surface of said at least one pulverizing roller is eccentric to the outside from a sectional center line of said annular groove of said pulverizing table, thereby forming said wedge-like gap between said outer peripheral surface of said at least one pulverizing roller and said upper surface of the pulverizing table.

* * * * *